US009347008B2

(12) United States Patent
Kuske et al.

(10) Patent No.: US 9,347,008 B2
(45) Date of Patent: May 24, 2016

(54) DEVICE FOR INFLUENCING THE FLOW IN A CONNECTING PIPE OF A COAL GASIFICATION REACTOR/GAS COOLER

(75) Inventors: Eberhard Kuske, Soest (DE); Lothar Semrau, Essen (DE)

(73) Assignee: ThyssenKrupp Uhde GmbH, Dortmund (DE)

( * ) Notice: Subject to any disclaimer, the term of this patent is extended or adjusted under 35 U.S.C. 154(b) by 1103 days.

(21) Appl. No.: 13/321,336

(22) PCT Filed: Apr. 21, 2010

(86) PCT No.: PCT/EP2010/002417

§ 371 (c)(1),
(2), (4) Date: Nov. 21, 2011

(87) PCT Pub. No.: WO2010/133281

PCT Pub. Date: Nov. 25, 2010

(65) Prior Publication Data

US 2012/0058015 A1 Mar. 8, 2012

(30) Foreign Application Priority Data

May 20, 2009 (DE) ..... 10 2009 022 186

(51) Int. Cl.
*B01J 7/00* (2006.01)
*C10J 3/22* (2006.01)

(52) U.S. Cl.
CPC ..... *C10J 3/22* (2013.01); *C10J 2300/095* (2013.01)

(58) Field of Classification Search
USPC ..... 48/198.3, 127.1, 127.9, 61, 76, 71, 72, 48/73, 74, 200, 201, 202, 203, 204, 210, 48/212, 213; 261/62, 63
See application file for complete search history.

(56) References Cited

U.S. PATENT DOCUMENTS 2,192,499 A 10/1938 Larner
2,410,960 A 11/1946 Bunn
(Continued)

FOREIGN PATENT DOCUMENTS

AT 267 479 6/2004
DE 11 16 487 * 11/1961
(Continued)

OTHER PUBLICATIONS

European Office Action dated Mar. 24, 2015 in European Application No. 10 715 704.2 with English translation of the relevant parts.

*Primary Examiner* — Kaity Handal
(74) *Attorney, Agent, or Firm* — Collard & Roe, P.C.

(57) ABSTRACT

With a device for influencing the flow, particularly in a horizontal connecting pipe (1) between a coal gasification reactor and a gas cooler/purifier, a solution is supposed to be created, whose task consists in being able to reduce or shut off the gas stream of a hot synthesis gas, if necessary, without being exposed to the great stresses caused by the corrosiveness and the high temperatures, while avoiding complicated valves or regulation devices.

Figure 1:
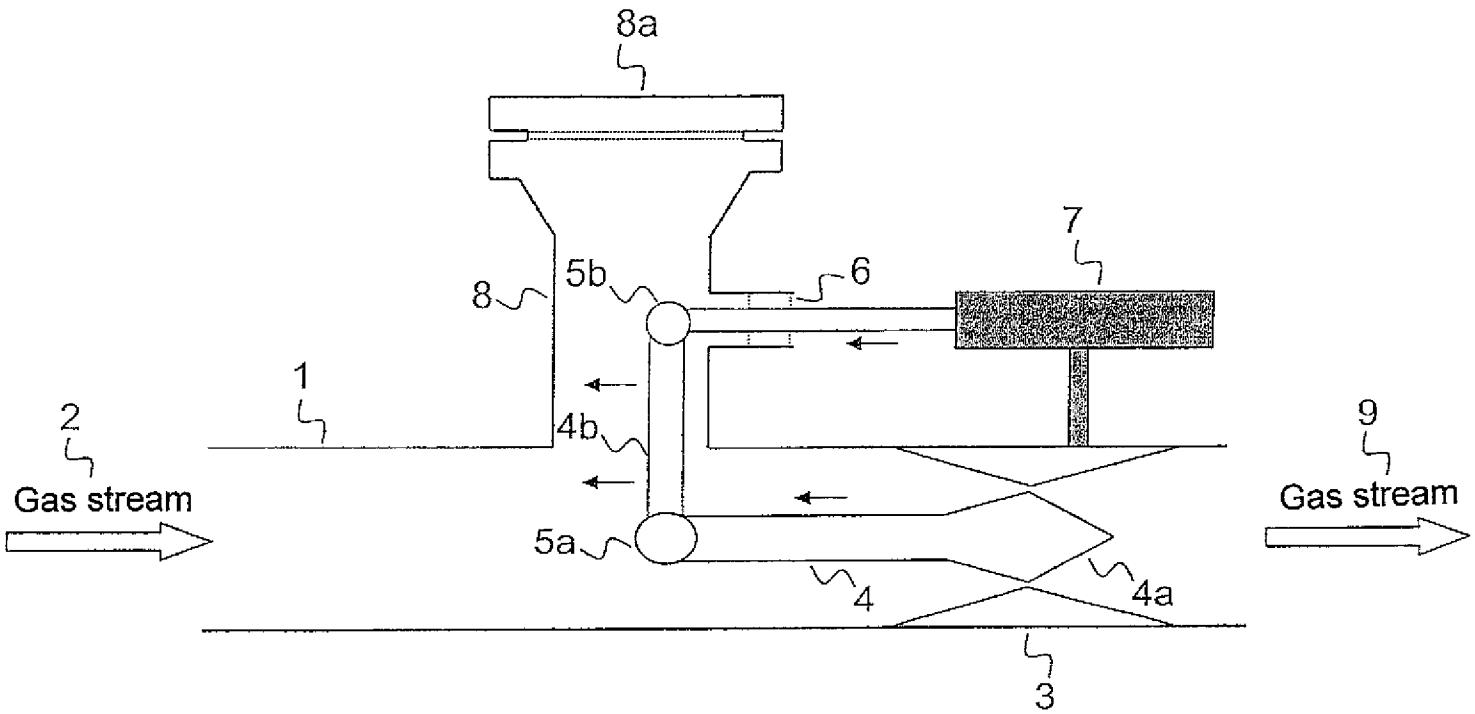

This is achieved by means of a Venturi constriction in the flow path of the gas in the pipe (1), as well as a flow cone (4*a*) positioned on a push rod (4) that is disposed centrally, whereby a connecting rod system (4*b*) that is guided to the outside is provided to move the push rod (4), whereby the connecting rod system (4*b*) that moves the push rod (4) is formed by a connecting rod arm guided in a dummy connector and a connecting rod arm guided out of the dummy connector (8) by way of a packed gland (6).

5 Claims, 4 Drawing Sheets

(56) References Cited

U.S. PATENT DOCUMENTS

| | | | | | |
|---|---|---|---|---|---|
| 2,657,124 | A | | 10/1953 | Gaucher | |
| 3,517,485 | A | | 6/1970 | Dell'Agnese et al. | |
| 3,638,925 | A | | 2/1972 | Braemer | |
| 3,675,397 | A | * | 7/1972 | Deacon | 96/248 |
| 3,690,044 | A | | 9/1972 | Boresta | |
| 3,839,185 | A | | 10/1974 | Vicard | |
| 4,023,942 | A | * | 5/1977 | Brady | B01D 47/10 261/112.1 |
| 4,144,041 | A | | 3/1979 | Hou | |
| 4,167,401 | A | | 9/1979 | Melnyk | |
| 5,211,916 | A | | 5/1993 | Cheng | |
| 5,604,319 | A | * | 2/1997 | Kohsaka | G01N 1/2247 73/863.11 |
| 5,880,378 | A | * | 3/1999 | Behring, II | G01F 1/22 73/861.53 |
| 6,065,459 | A | * | 5/2000 | Stevens | F02B 29/02 123/590 |
| 6,597,148 | B1 | | 7/2003 | Niemelä | |
| 2002/0197574 | A1 | * | 12/2002 | Jones | F23C 6/047 431/8 |
| 2003/0130360 | A1 | * | 7/2003 | Kindig | B01J 7/00 518/703 |
| 2006/0056924 | A1 | * | 3/2006 | Jurkovich | B65G 53/66 406/39 |
| 2006/0180224 | A1 | * | 8/2006 | Berggren | F02D 9/12 137/892 |

FOREIGN PATENT DOCUMENTS

| | | | |
|---|---|---|---|
| DE | 18 76 032 | | 7/1963 |
| DE | 21 50 015 | | 4/1973 |
| DE | 26 50 071 | A1 | 5/1978 |
| DE | 199 52 754 | | 5/2001 |
| GB | 27603 | | 0/1913 |

* cited by examiner

DEVICE FOR INFLUENCING THE FLOW IN A CONNECTING PIPE OF A COAL GASIFICATION REACTOR/GAS COOLER

CROSS REFERENCE TO RELATED APPLICATIONS

This application is the National Stage of PCT/EP2010/002417 filed on Apr. 21, 2010, which claims priority under 35 U.S.C. §119 of German Application No. 10 2009 022 186.7 filed on May 20, 2009, the disclosure of which is incorporated by reference. The international application under PCT article 21(2) was not published in English.

The invention is directed at a device for influencing the flow in a horizontal connecting pipe between a coal gasification reactor and a gas cooler/purifier.

A production possibility for synthesis gas consists in the gasification of finely ground fuels that contain carbon, with a gas that contains oxygen. In this connection, a gaseous product is obtained, which consists essentially of carbon monoxide. When steam is mixed into the starting gas, a product gas is obtained that also contains hydrogen as an admixture. The synthesis gas obtained in this manner is suitable for the production of ammonia or methanol, for example, but also for making hydrogen available.

In the production of synthesis gas by means of a coal gasification process, a coal gasification reactor is used, which yields a synthesis gas charged with solids and acidic gases. For further use, this gas must be purified, so that it is passed into a device for gas scrubbing. In order to be able to control the gas stream from the reactor into the device for gas scrubbing, it is necessary to interrupt or regulate the gas stream.

However, regulation with conventional valves or slides frequently requires maintenance or is subject to break-down, because the synthesis gas is hot and can be charged with corrosive components. Conventional valves or slides must therefore be replaced after some time, and this leads to increased operating costs and increased maintenance effort.

This is where the invention takes its start; its task consists in being able to reduce or shut off the gas stream of a hot synthesis gas, if necessary, without being exposed to the high stresses caused by the corrosiveness and the high temperatures, while avoiding complicated valves or regulation devices.

This task is accomplished with a device of the type indicated initially, by means of a Venturi constriction in the flow path of the gas in the pipe, as well as a flow cone positioned on a push rod that is guided centrally, whereby a connecting rod system that is guided to the outside is provided to move the push rod, whereby the connecting rod system that moves the push rod is formed by a connecting rod arm guided in a dummy connector and a connecting rod arm guided out of the dummy connector by way of a packed gland.

By means of the invention, an optimal regulation possibility is made available, using simple means, within a horizontal connecting pipe between the coal gasification reactor, on the one hand, and a gas scrubber, on the other hand.

At this point, it should be noted that a high-performance wet precipitator is known from DE 21 50 015 A, for example, which is formed by a pipe in which a flow cone sits to produce a Venturi effect, whereby this cone is slightly adjustable longitudinally, in order to be able to adjust the flow speed and the throughput in the pipe; here, a longitudinal displacement device that can be activated from the outside is not provided, nor are any special measures for temperature stabilization.

In the literature, a number of solutions are known, in which installations are provided in flow paths, which serve to regulate the flow, particularly also to block off the flow path, whereby Venturi-like elements are provided, which are installed, with some exceptions, not in the horizontal direction, as shown in U.S. Pat. No. 3,839,185, but rather in the vertical direction. DE 199 52 754 A1, DE 18 76 032 U, AT 267 479 B, U.S. Pat. No. 3,517,485, U.S. Pat. No. 3,638,925, U.S. Pat. No. 3,690,044, or U.S. Pat. No. 4,167,401 are mentioned as examples.

Embodiments of the invention are evident from the dependent claims. In this connection, it can be provided that the push rod is provided with a setting device, whereby it is practical if the connecting rod arm that impacts the push rod, which lies on the inside and is guided to the outside, interacts with such a setting device.

In a further embodiment, it is provided, according to the invention, that the setting device is configured for mechanical and/or electrical and/or hydraulic adjustment of the push rod.

It can be practical, as the invention also provides in a further embodiment, that at least two dummy connectors, particularly three dummy connectors having connecting rod arms that impact the push rod are provided, and that particularly great stability and functional reliability are guaranteed by means of the three-arm configuration.

Another practical embodiment of the invention consists in that water injectors are provided in the flow path of the gas in the pipe, ahead of the Venturi constriction.

Depending on the type of construction, it can be advantageous to configure part of these water injectors as support elements for the push rod, at the same time.

In order to deal with the stresses that occur, the invention also provides, in a further embodiment, that at least the elements and surfaces that stand in contact with the gas that flows through consist of a corrosion-resistant material or are provided with a corrosion-resistant coating.

This embodiment is advantageous, because synthesis gas that is produced can have temperatures of 200° to 1700° C., whereby the pressures of the synthesis gas can amount to between 0.1 to 30 MPa, whereby this numerical information serves only as an example, without the invention being restricted to this.

Further details, characteristics, and advantages of the invention are evident from the following description and from the drawing. This shows, in FIG. 1 in a simplified representation, the connecting pipe according to the invention, with the device in section, with the flow cone in the closed position, FIG. 2 in a similar representation, the flow cone in the open position, FIG. 3 a cross-section through a pipe equipped with a device according to the invention, having three setting devices, as well as in FIG. 4 in the representation of FIG. 2, the device according to the invention with water injection.

FIG. 1 shows a connecting pipe 1 through which a gas stream 2 is guided, proceeding from a coal gasification reactor. The gas stream must pass through a constriction 3 as it is guided through the pipe. This constriction is blocked off by means of a push rod 4 having a flow cone in the form of a thickened region 4*a*. The guide rod is passed to the outside by way of a connecting rod system 4*b* having two nodes 5*a*, 5*b*, through a packed gland 6, and driven by a setting device in the form of an actuator motor 7 there. The connecting rod 4*b* is guided by a dummy connector 8 that is blocked off with a closure lid 8*a*. The gas stream 9 exits at the end of the connecting piece, where a device for gas scrubbing follows.

Figure 2:
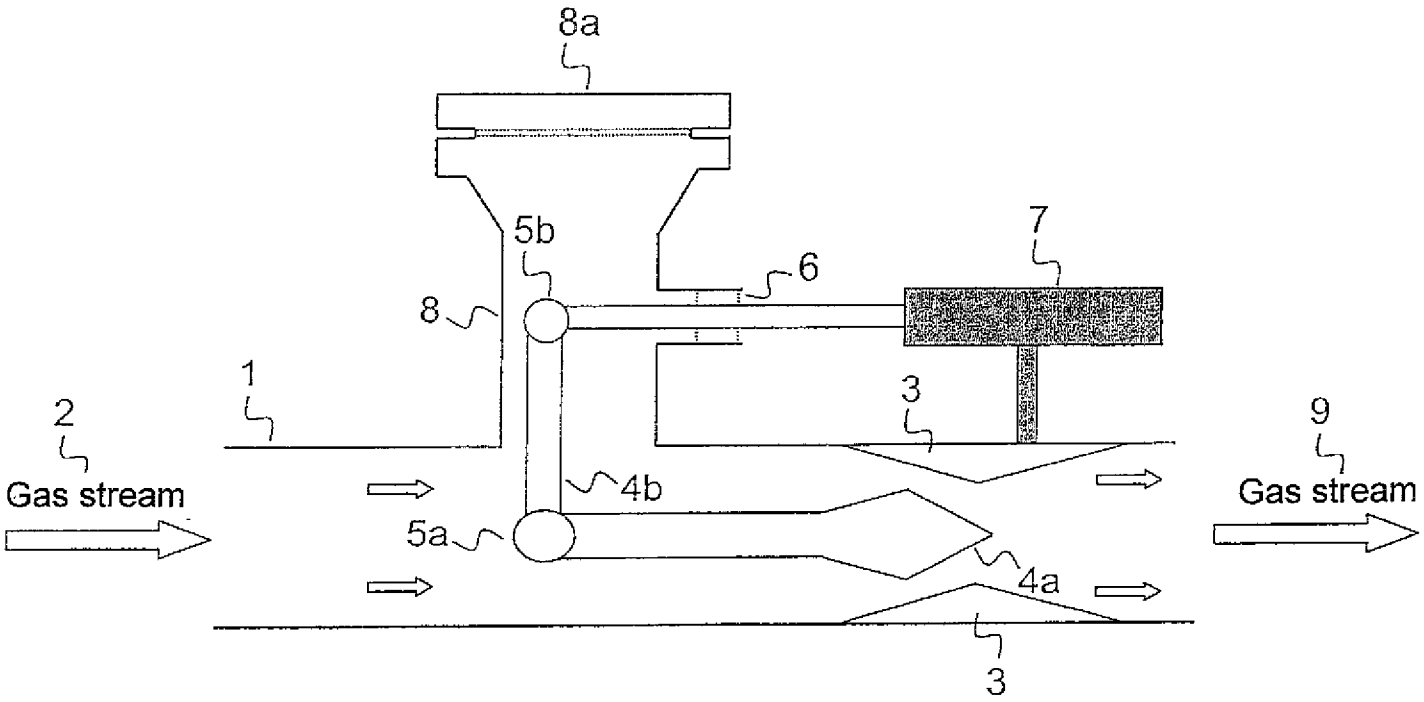

FIG. 2 shows a connecting pipe 1 through which a gas stream 2 is guided, proceeding from a coal gasification reactor. The gas stream 2 must pass through a constriction 3 as it is guided through the pipe. A push rod 4 having a flow cone in the form of a thickened region 4*a*, which is retracted here, leads through the pipe. As a result, the pipe is passable for the gas stream.

Figure 3:
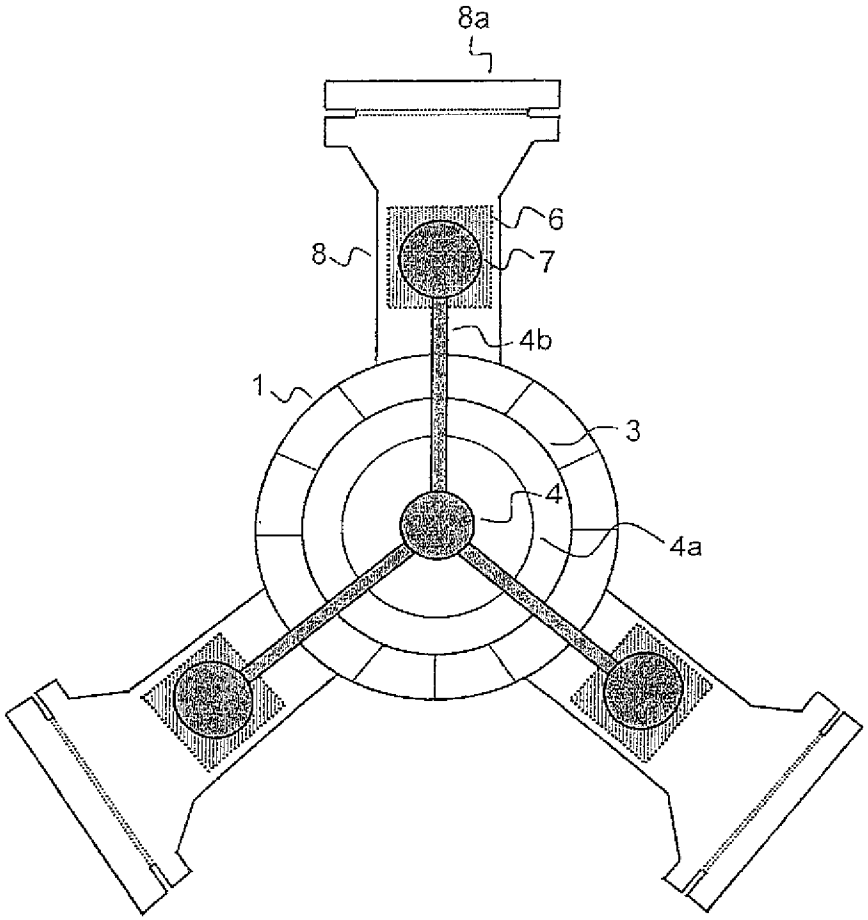

FIG. 3 shows the connecting pipe 1 in the frontal view. The pipe is constricted, in cross-section, by means of a constriction 3, with which the velocity of the gas stream is increased. A flow cone in the form of a thickened region 4*a*, which is permeable for part of the gas stream 4*c* here, is guided through the constriction. The thickened region is affixed to a push rod 4 that is connected with a setting device in the form of an actuator motor 7 by way of a connecting rod system 4*b*. The connecting rod is guided in a dummy connector 8 by way of a packed gland 6. Here, the closure lid 8*a* can also be seen.

Figure 4:
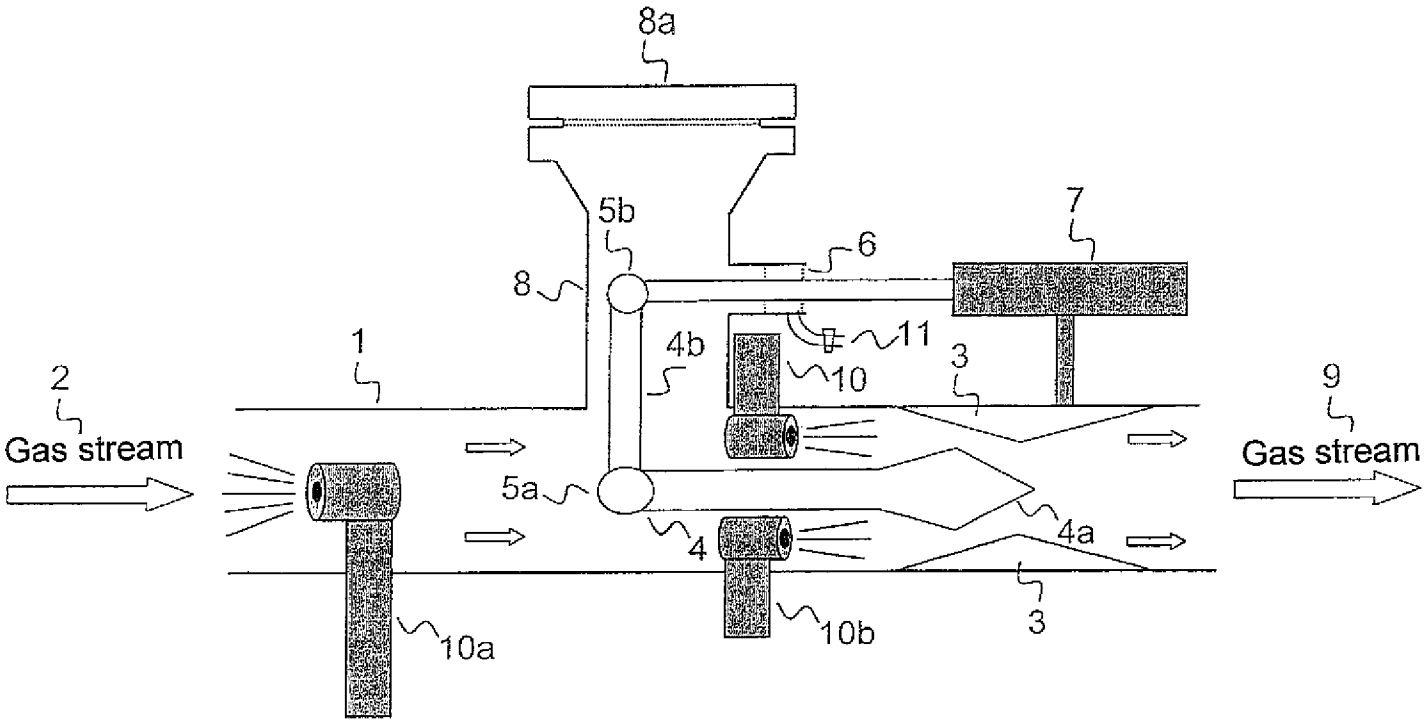

FIG. 4 shows the connecting pipe according to the invention with water injection devices. One of them is directed backward 10*a* in the gas stream, and another is directed forward 10*b*. Here, a device for venting the packed gland 11 can also be seen. Here, the device is in the open position.

REFERENCE SYMBOL LIST

1 connecting pipe
2 entering gas stream
3 constriction
4 push rod
4*a* thickened region
4*b* connecting rod system
4*c* part of the gas stream
5*a* node
5*b* node
6 packing gland
7 actuator motor
8 dummy connector
8*a* closure lid for dummy connector
9 exiting gas stream
10*a* water injection device, directed backward
10*b* water injection device, directed forward
11 venting device

The invention claimed is:

1. Device for influencing the flow in a horizontal connecting pipe (1) between a coal gasification reactor and a gas cooler/purifier, comprising a Venturi constriction in the flow path of the gas in the pipe (1), as well as a flow cone positioned on a push rod (4), the push rod being guided centrally in the pipe, whereby a connecting rod system (4*b*) that is guided to the outside is provided to move the push rod (4), whereby the connecting rod system (4*b*) that moves the push rod (4) is formed by a connecting rod arm guided in a dummy connector and a connecting rod arm guided out of the dummy connector (8) by way of a packed gland (6), wherein water injectors (10*a*, 10*b*) are provided in the flow path of the gas in the pipe (1) ahead of the Venturi constriction (3), wherein at least a part of the water injectors (10*a*,10*b*) are configured as support elements for the push rod (4).

2. Device according to claim 1, wherein the push rod (4) is provided with a setting device.

3. Device according to claim 2, wherein the setting device is configured for mechanical and/or electrical and/or hydraulic adjustment of the push rod.

4. Device according to claim 1, wherein at least two dummy connectors (8), particularly three dummy connectors (8), having a connecting rod system that impacts the push rod, are provided on the pipe (1).

5. Device according to claim 1, wherein at least the elements that stand in contact with the gas that flows through consist of a corrosion-resistant material or are provided with a corrosion-resistant coating.

* * * * *